United States Patent [19]

Kelley et al.

[11] 4,108,561

[45] Aug. 22, 1978

[54] APPARATUS FOR FORCIBLY ENGAGING MACHINE ASSEMBLIES

[75] Inventors: James E. Kelley, Metamora; Orrin A. Stemler, East Peoria, both of Ill.

[73] Assignee: Caterpillar Tractor Co., Peoria, Ill.

[21] Appl. No.: 794,000

[22] Filed: May 5, 1977

[51] Int. Cl.[2] ..... F16B 7/10

[52] U.S. Cl. ..... 403/166; 214/145 A

[58] Field of Search ..... 403/166, 335, 337; 214/145 A, 131 A; 64/8, 23

[56] References Cited

U.S. PATENT DOCUMENTS

| | | | |
|---|---|---|---|
| 2,685,759 | 8/1954 | Ravich et al. | 403/166 X |
| 3,237,795 | 3/1966 | Kromer | 214/145 A |

FOREIGN PATENT DOCUMENTS

| | | | |
|---|---|---|---|
| 1,279,491 | 11/1961 | France | 214/145 A |
| 62,744 | 2/1955 | France | 214/145 A |
| 1,164,323 | 2/1964 | Fed. Rep. of Germany | 214/145 A |

*Primary Examiner*—Price C. Faw, Jr.
*Assistant Examiner*—Conrad L. Berman
*Attorney, Agent, or Firm*—John L. James

[57] ABSTRACT

A locking apparatus has first and second assemblies each containing an inclined plane. The inclined planes contact one another at a locking position and releasably fix the first assembly to the second assembly. The apparatus includes means for urging one of the inclined planes into the other at a force sufficient for maintaining the inclined planes in contact one relative to the other during movement of one assembly relative to the other and during wear for maintaining locking contact and compensating for the wear.

8 Claims, 2 Drawing Figures

Fig. 1.
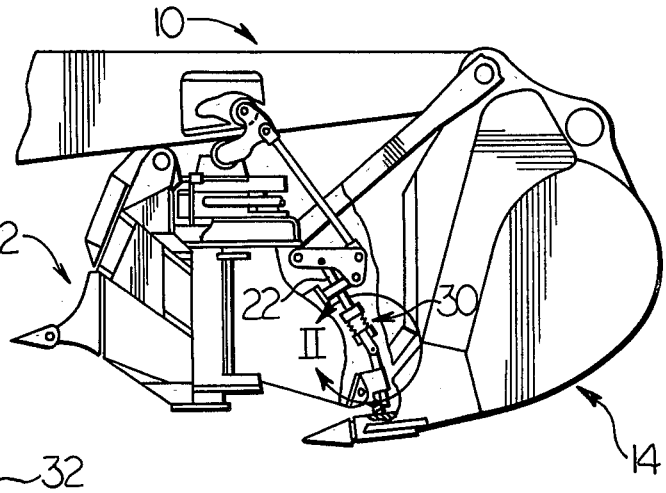
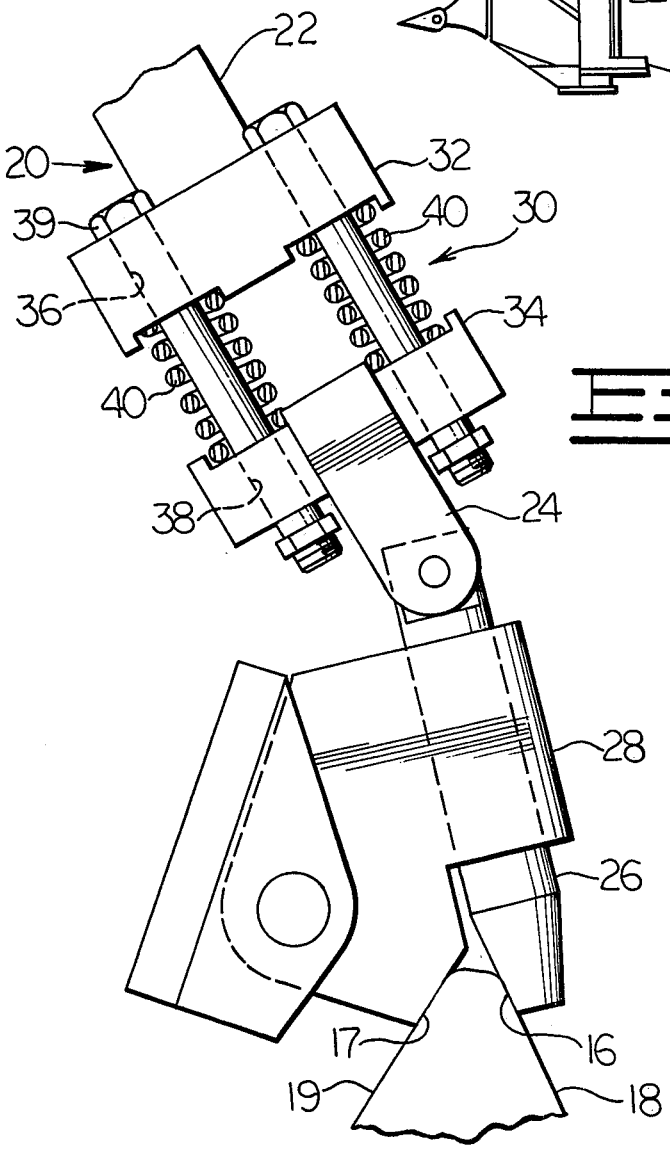
Fig. 2.

APPARATUS FOR FORCIBLY ENGAGING MACHINE ASSEMBLIES

BACKGROUND OF THE INVENTION

Earth engaging equipment, such as an excavator for example, has various assemblies which are subjected to vibration and wear. An excavator has a bucket assembly and rockbreaker assembly which can be coupled to perform a specific task. When coupled, there is often undesirable movement between the two assemblies when rocks or other stubborn materials are encountered. Movement of the bucket assembly relative to the rockbreaker assembly can cause wear and failure of components of the rockbreaker assembly. When severely worn, costly repair or replacement of these components is necessary. It is therefore desirable to provide a device which will reduce the effects of vibration and wear.

SUMMARY OF THE INVENTION

The present invention is directed to overcoming one or more of the problems as set forth above.

According to the present invention, apparatus is provided which has first and second assemblies each containing an inclined plane. The inclined planes contact one another at a locking position and releasably fix the first assembly to the second assembly. The apparatus includes means for urging one of the inclined planes into the other at a force sufficient for maintaining the inclined planes in forcible contact during vibrational movement of one assembly relative to the other assembly and during wear for maintaining locking contact and automatically compensating for the wear.

BRIEF DESCRIPTION OF THE DRAWINGS

FIG. 1 is a partial side view of an excavator rockbreaker attachment; and

FIG. 2 is a somewhat enlarged side view of the encircled portion II of FIG. 1.

DETAILED DESCRIPTION

Referring to FIGS. 1 and 2, an apparatus, such as an excavator 10 for example, has first and second assemblies, such as a rockbreaker assembly 12 and a bucket assembly 14. The rockbreaker 12 and bucket 14 each contain a pair of inclined planes 16,17 and 18,19 which contact one another at a locking position and releasably fix the rockbreaker 12 to the bucket 14. The rockbreaker assembly 12 includes an elongated member 20 which has first and second end portions 22,24. The second end portion 24 is preferably pivotally connected to a pin 26 which slides in a bracket 28 and contains the inclined plane 16. The first end portion 22 is movable and urges the inclined plane 16 against the inclined plane 18 which causes bracket 28 to pivot and urge inclined planes 17,19 against one another to fixedly position the rockbreaker 12 relative to the bucket 14.

Referring to FIG. 2, a link assembly 30 physically separates the end portions 22,24 of the elongated member 20. The link assembly 30 includes first and second flanges 32,34 which are connected to the first and second end portions 22,24 respectively, as by welding or the like. The first flange 32 contains a number of holes 36 which are alignable with corresponding holes 38 in the second flange 34. The flanges 32,34 are movably connected by nut and bolt assemblies 39 or the like disposed in corresponding pairs of holes 36,38. A spring 40 or the like is preferably entrained about each bolt 39. The flanges 32,34 are movable between a first position at which the spring 40 is substantially free of load and a second position at which the spring 40 is subjected to a load.

The spring 40 is preferably a coil spring which has a spring constant and construction sufficient for maintaining forcible contact of the inclined planes 16,18 and 17,19 during vibrational movement and wear of the inclined planes 17,19. One skilled in the art can readily determine the spring constant once the conditions to be encountered during operation of the excavator are known. The vibrational movement of the rockbreaker 12 relative to the bucket 14 will depend upon the size and composition of the rocks and other material encountered during operation. The abrasiveness of the material encountered and hardness of the inclined planes 17,19 will determine the wear rate of the inclined planes 17,19 during operation of the rockbreaker 12. Wear of the inclined planes 17,19 increases the effects of vibration and can cause failure of stop 42 which has inclined planes 18,19.

In operation, the inclined planes 16,18 and 17,19 contact one another, respectively, at a locking position and fix the rockbreaker 12 relative to the bucket. When contact is made, the spring 40 is compressed and urges the inclined planes 16,18 and 17,19 together. As the inclined planes 17,19 wear, the spring 40 exerts sufficient force against the pin 26 and the inclined planes 16,18 to keep the inclined plane 17 wedged against the inclined plane 19 thereby automatically compensating for the wear. The spring 40 also minimizes movement, caused by vibration or other forces, of one plane against the respective mating plane. When the planes 16,18 and 17,19 are tightly urged one against the other, the rockbreaker 12 and bucket 14 cooperate and act as a unitary structure.

Other aspects, object, and advantages of the present invention will become apparent from a study of the specification, drawings, and appended claims.

The embodiment of the invention in which an exclusive property or privilege is claimed are defined as follows:

1. In an apparatus having first and second assemblies each having at least one inclined plane, said first assembly including a first member having first and second end portions with said inclined plane on the first end portion, said inclined planes contacting one another at a locking position and releasably fixing said first assembly to said second assembly, the improvement comprising:

means for urging one of the inclined planes into the other inclined plane at a force sufficient for maintaining the inclined planes in forcible contact with each other during vibrational movement of one of said first and second assemblies and during wear of the inclined planes for maintaining locking contact and automatically compensating for said wear, said urging means including a link assembly connected to and positioned between the end portions of the first member.

2. An apparatus, as set forth in claim 1, wherein the link assembly includes first and second flanges each having at least one opening and being fastened to said first and second end portions, respectively, said first flange opening being generally alignable with said second flange opening.

3. An apparatus, as set forth in cliam 2, wherein the link assembly includes a spring having a preselected spring constant and being positioned between said first and second flanges and seated about said flange openings, said flanges being displaced toward each other at the locking position of the first and second assemblies and compressing said spring a preselected amount.

4. An apparatus, as set forth in claim 3, including a bolt having at least one nut thereon and being positioned in said opening of said first flange and in the corresponding opening of said second flange, one of said flanges being movable along said bolt to compress said spring.

5. An apparatus, as set forth in claim 4, wherein the bolt is positioned within the spring.

6. In an apparatus having a rockbreaker assembly and a bucket assembly, said bucket assembly having at least one inclined plane, said rockbreaker assembly having an elongated member with first and second end portions with an inclined plane on the first end portion, said inclined planes contacting one another at a locking position and fixing the rockbreaker assembly to the bucket assembly, the improvement comprising:

a spring assembly having one end connected to the first end portion of the elongated member opposite the inclined plane and the other end connected to the second end portion of the elongated member opposite the rockbreaker assembly, said spring assembly separating the elongated member into the first and second end portions.

7. An apparatus, as set forth in claim 6, wherein the spring assembly includes a spring positioned between the first and second end portions of the elongated member and compressed a preselected amount.

8. An apparatus, as set forth in claim 7, wherein the spring is further compressed at the locking position of the inclined planes and urges against the first end portion of the elongated member, said first end portion being moved away from the second end portion in response to urging by the spring and wear of the inclined planes and automatically compensating for wear of the inclined planes.

* * * * *